US010371390B2

(12) United States Patent
Lee et al.

(10) Patent No.: US 10,371,390 B2
(45) Date of Patent: Aug. 6, 2019

(54) COOKING APPLIANCE

(71) Applicant: LG ELECTRONICS INC., Seoul (KR)

(72) Inventors: Wanglim Lee, Seoul (KR); Cheonghwan Yu, Seoul (KR)

(73) Assignee: LG Electronics Inc., Seoul (KR)

( * ) Notice: Subject to any disclaimer, the term of this patent is extended or adjusted under 35 U.S.C. 154(b) by 453 days.

(21) Appl. No.: 15/147,524

(22) Filed: May 5, 2016

(65) Prior Publication Data

US 2016/0327283 A1 Nov. 10, 2016

(30) Foreign Application Priority Data

May 8, 2015 (KR) ..... 10-2015-0064915

(51) Int. Cl.

| | |
|---|---|
| ***F24C 15/00*** | (2006.01) |
| ***F24C 15/32*** | (2006.01) |
| ***F24C 3/12*** | (2006.01) |
| *F24C 15/02* | (2006.01) |

(52) U.S. Cl.

CPC ..... *F24C 15/32* (2013.01); *F24C 3/124* (2013.01); *F24C 15/002* (2013.01); *F24C 15/02* (2013.01)

(58) Field of Classification Search

CPC ..... F24C 3/124; F24C 15/32; F24C 15/002; F24C 15/02; F24C 15/006; A47B 96/20; A47B 77/08

See application file for complete search history.

(56) References Cited

U.S. PATENT DOCUMENTS

| | | | | |
|---|---|---|---|---|
| 7,431,029 | B2 | 10/2008 | Kim et al. | |
| 2005/0133019 | A1* | 6/2005 | Kim | F24C 15/006 126/198 |
| 2006/0278214 | A1* | 12/2006 | Park | F24C 15/006 126/273 R |

FOREIGN PATENT DOCUMENTS

| | | |
|---|---|---|
| DE | 4033989 | 4/1992 |
| DE | 10128369 | 12/2002 |
| KR | 20-0152112 | 4/1999 |
| KR | 10-2002-0056254 | 7/2002 |
| KR | 20-0312816 | 5/2003 |
| KR | 10-2012-0020769 | 3/2012 |
| KR | 10-2014-0018565 | 2/2014 |

OTHER PUBLICATIONS

Extended European Search Report issued in European Application No. 16167892.5 dated Sep. 7, 2016, 5 pages.

Notice of Allowance issued in Korean Application No. 10-2015-0064915 dated Nov. 21, 2016, 3 pages (with English translation).

* cited by examiner

*Primary Examiner* — Alfred Basichas

(74) *Attorney, Agent, or Firm* — Fish & Richardson P.C.

(57) ABSTRACT

A cooking appliance may include a case that defines a cavity for cooking, a top plate that is disposed above the cavity and that is configured to define an external appearance of a top side of the cooking appliance, a control panel that is disposed at a front upper position of the cavity and that is configured to define an external appearance of a front side of the cooking appliance, the control panel having a knob for user operation, and a door that is disposed below the control panel and that is configured to define, along with the control panel, the external appearance of the front side of the cooking appliance, the door being configured to open or close the cavity.

19 Claims, 9 Drawing Sheets

COOKING APPLIANCE

This application claims the benefit of Korean Patent Application No. 10-2015-0064915, filed on May 8, 2015, which is hereby incorporated by reference as if fully set forth herein.

BACKGROUND

Generally, a cooking appliance may be a household appliance that is used to cook food using electricity or other kinds of energy (e.g. gas)

Among these cooking appliances, a cooking appliance that uses gas as a heat source includes a gas range, a gas oven, or a gas oven range, and a cooking appliance that uses electricity as a heat source includes an induction range or a microwave oven. In addition, there is a cooking appliance in which an induction range using electricity and a gas oven using gas are combined with each other.

In particular, in the case of a gas oven range, a gas range may be located at the top to form a first cooking unit, and a gas oven may be located below the gas range to form a second cooking unit.

SUMMARY

Accordingly to one aspect, a cooking appliance may include a case that defines a cavity for a cooking space, a top plate that is disposed above the cavity and that is configured to define an external appearance of a top side of the cooking appliance, a control panel that is disposed at a front upper position of the cavity and that is configured to define an external appearance of a front side of the cooking appliance, the control panel having a knob for user operation, and a door that is disposed below the control panel and that is configured to define, along with the control panel, the external appearance of the front side of the cooking appliance, the door being configured to open or close the cavity, where the control panel includes an air passage that is defined in a lower surface of the control panel, that receives air discharged from the cavity through the door, and that introduces received air into an interior of the control panel.

Implementations according to this aspect may include one or more of the following features. For example, the control panel may include a rear opening that is configured to allow communication between an interior space of the control panel and an interior space of the cooking appliance. The rear opening may be configured to allow communication between a space defined between the top plate and the cavity, and the interior space of the control panel. The cooking appliance may include a burner case provided between the cavity and the top plate, and the interior space of the control panel and a space between the top plate and the burner case communicate with each other through the rear opening. The air passage may be configured to be substantially parallel to a ground surface. The air passage may be defined as an elongated hole with a horizontal orientation. The air passage may be located at a rear position in the lower surface of the control panel. The cooking appliance may include a partition provided on the lower surface of the control panel at a position in front of the air passage. The cooking appliance may include a bracket with a base coupled to the lower surface of the control panel, the base including a base hole corresponding to the air passage. The partition may be bent downward from the base. The partition may be configured to be rearwardly and downwardly inclined. The control panel may be a manifold-type control panel configured to include a front inclined surface, opposite side surfaces, and the lower surface, wherein the lower surface is configured to protrude forward from a front surface of the door. The inclined surface may be provided with a plurality of knobs for user operation. The cooking appliance may include a rear panel that is configured to define a rear side of the cooking appliance, the rear panel including an outlet port configured to discharge air inside the cooling appliance. The air passage may be vertically above a contact surface at which the door and the cavity come into contact with each other.

According to another aspect, a cooking appliance may include a cabinet, a cavity provided inside the cabinet that is configured to form a cooking space, a top plate that is disposed above the cavity that is configured to define an external appearance of a top side of the cooking appliance, a door that is configured for opening or closing the cavity, and a control panel that is disposed above an upper end surface of the door and configured to include a gap between the control panel and the end surface of the door, the control panel and the door configured to define an external appearance of a front side of the cooking appliance, the control panel including a lower surface which is configured to protrude further forward than the upper end surface of the door, where the control panel includes an air passage formed at a rear position in the lower surface of the control panel, wherein the air passage is configured to allow hot air discharged from the cavity to be introduced into an interior of the control panel.

Implementations according to this aspect may include one or more of the following features. For example, the air passage may be configured to have a longer left-right length than a front-rear length, and is configured to be parallel to a ground surface. A partition may be provided in front of the air passage to separate a front region and a rear region of the air passage from each other. The partition may be configured to extend downward from the lower surface of the control panel in a direction in which the gap is reduced. The hot air introduced into the control panel through the air passage may be configured to pass through a rear opening formed in the control panel, a space between the top plate and a burner case, provided between the cavity and the top plate, and an outlet port formed in a rear panel provided for forming a rear side of the cooling appliance, to be discharged to an outside of the cooking appliance.

DETAILED DESCRIPTION

Figure 1:
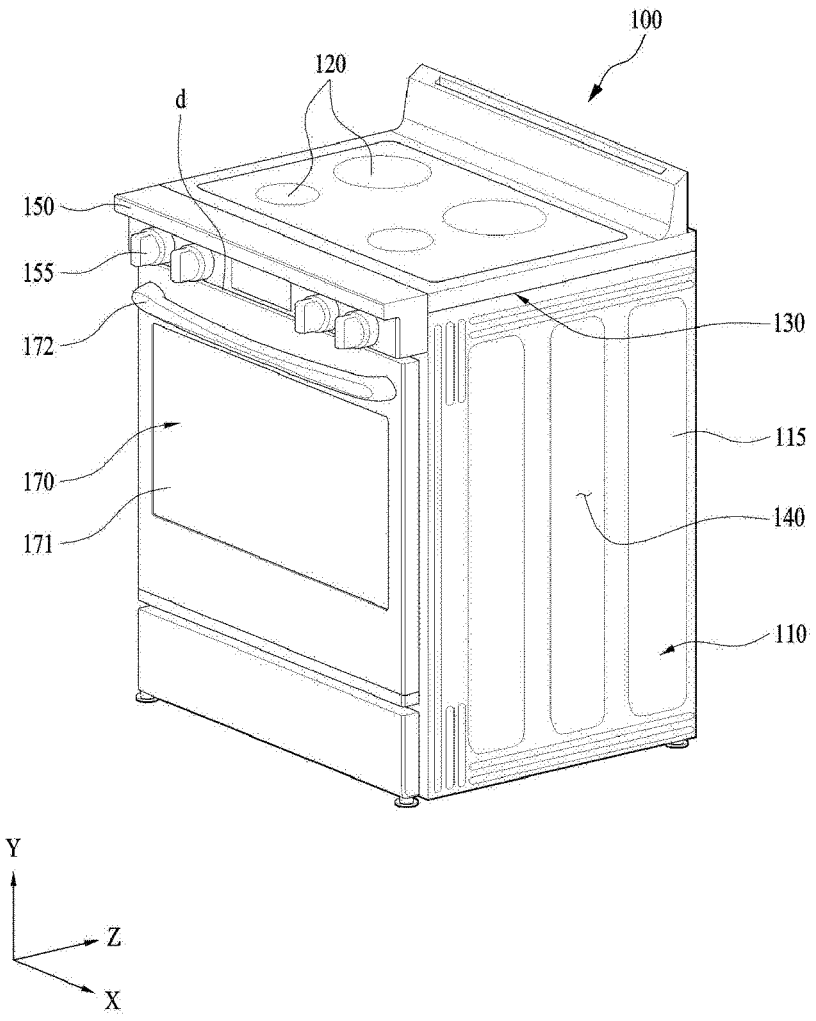
FIG. 1 is a perspective view illustrating a conventional slide-in panel type cooking appliance.

FIG. 1 illustrates a general gas oven range. The cooking appliance 100 may include a cabinet 110 for defining the external appearance of the cooking appliance 100, a top plate 130 disposed on the top of the cabinet 110, the top plate 130 being provided with a first cooking unit 120, a second cooking unit 140 provided inside the cabinet 110, a control panel 150 coupled to the front end of the top plate 130, and a door 170 installed to the front surface of the cabinet 110 for opening or closing the second cooking unit 140. The control panel 150 may have a knob 155 for user operation.

The cabinet 110 internally defines the space for accommodating the second cooking unit 140 in which cooking is performed using a heat source. The cabinet 110 may include opposite sidewalls 115 in the width direction as well as a rear wall. The second cooking unit 140 may generally be referred to as a cavity in terms of the configuration of the cooking appliance.

The top plate 130 may be seated on the top of the cabinet 110. At least one first cooking unit 120, on which cooking is performed using a heat source, may be installed via the top plate 130.

The control panel 150 may be coupled to the front end of the top plate 130. Specifically, the control panel 150 may be coupled to the top plate 130 at a position above the door 170, which is provided at the front surface of the cabinet 110 in order to open or close the second cooking unit 140.

The door 170 may be provided at the front surface of the cabinet 110 in order to open or close the second cooking unit 140. The door 170 may include a transparent portion 171 configured to allow the interior of the second cooking unit 140 to be viewed, and a handle 172 for assisting the user in opening or closing the door 170.

In addition, the control panel 150 may include at least one operating unit 155. Specifically, the operating unit 155 may take the form of a rotatable knob.

The user may ignite gas provided to the first cooking unit 120 and the second cooking unit 140 by rotating the operating unit 155, or may adjust the intensity of fire burning in the first cooking unit 120 and the second cooking unit 140.

The interior region of the second cooking unit 140, provided inside the cabinet 110, is at a very high temperature. This high-temperature may expand to the exterior region of the second cooking unit 140. In particular, the high-temperature may be transferred to the control panel 150 provided at the front surface of the cabinet 110. In particular, hot air inside the cavity may be transferred to the control panel 150 through a gap "d" between the upper end of the door 170 and the lower end of the control panel 150. That is, there is a risk of the temperature of the control panel 150 being increased due to the second cooking unit 140.

The control panel 150 is a component to be operated by the user. The user may touch the control panel 150, or may grip and operate the knob 155 provided on the control panel 150.

Therefore, the user may be burned by the high-temperature control panel 150. Generally, the space or gap "d" may be present between the upper end of the door 170 and the control panel 150, and hot air inside the cooking appliance may be discharged through the gap "d". That is, the temperature of the control panel 150 may be increased due to the hot air.

The cooking appliance 100 illustrated in FIG. 1 may be referred to as a slide-in panel type oven. The conventional cooking appliance 100 may be an oven in which the front surface of the control panel 150 is substantially perpendicular to the ground surface. The front end of the control panel 150 may be substantially in the same plane as the front end of the door 170. That is, as illustrated in FIG. 1, the front surface of the control panel 150 and the front surface of the door 170 define substantially the same plane.

Therefore, the slide-in panel type oven described above is generally configured to prevent an increase in the temperature of the control panel via forced convection.

Figure 2:
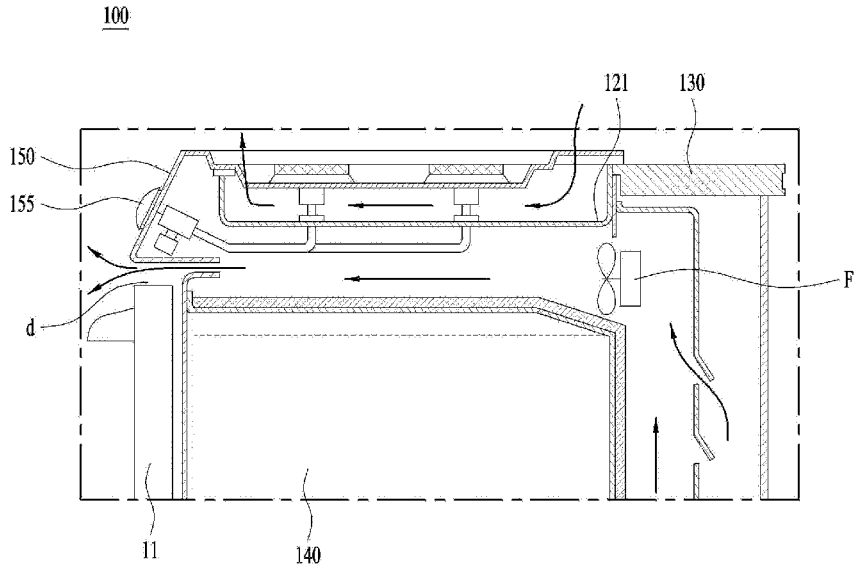
FIG. 2 is a sectional view illustrating the forced flow of air in a conventional manifold panel type cooking appliance.

The conventional cooking appliance 100 illustrated in FIG. 2 may be referred to as a manifold panel type oven. The front surface of the control panel 150 is inclined. As such, the knob 155 may be located in front of the user's eyes, which is convenient to use.

A fan F is provided above the rear end of the second cooking unit 140 or the cavity. The fan F suctions air from the rear side and discharges the air to the front side. Thus, airflow may be forcibly generated inside the cabinet 110 via the driving of the fan F. That is, outside air may be introduced into the cabinet 110 via the fan F, and thereafter may be discharged outward from the cabinet 110.

In particular, the air may be discharged to the front side of a door 11 through the gap "d" between the control panel 150 and the door 11 via the driving of the fan F. The forced flow of air may prevent the temperature of the control panel 150 from excessively increasing. In addition, some of the air may be introduced into a burner case 121 via the driving of the fan F.

Generally, in the case of the slide-in panel type oven illustrated in FIG. 1 or the manifold panel type oven illustrated in FIG. 2, the airflow is forcibly generated via the driving of the fan F. The forced flow of air prevents an increase in the temperature of the control panel 150.

Figure 3:
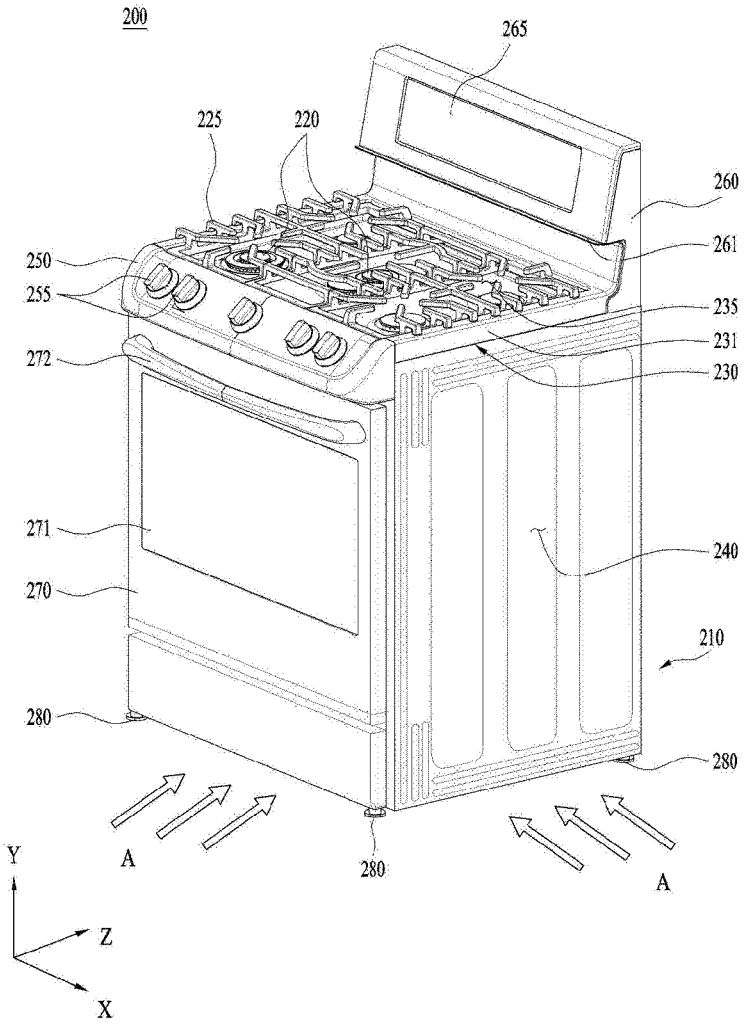
FIG. 3 is a perspective view illustrating an example of a cooking appliance.

Referring to FIG. 3, the cooking appliance 200 may include a cabinet 210 that defines the external appearance of the cooking appliance 200, a top plate 230 disposed on the top of the cabinet 210, the top plate 230 being provided with a first cooking unit 220, a second cooking unit 240 (hereinafter referred to as a cavity) provided inside the cabinet 210, a control panel 250 coupled to the front end of the top plate 230, and a door 270 installed to the front surface of the cabinet 210 for opening or closing the cavity 240.

The control panel 250 may be a manifold type control panel, unlike a slide-in type control panel. The control panel 250 may include an inclined front surface, and a knob 255 for user operation may be provided on the inclined surface. This configuration may assist the user in more easily operating the knob 255.

The control panel 250 may protrude further forward than the front surface of the door 270. In addition, in the case of a pull-down type door, hot air may be discharged outward through a gap between the upper end of the door 270 and the cavity 240. Therefore, a portion at which the door 270 and the cavity 240 come into contact with each other may be located at the back of the cooking appliance 200. This configuration may help to reduce the transfer of hot air inside the cavity 240 to the user.

The cabinet 210 internally defines the space for accommodating the cavity 240 where cooking is performed using a heat source. The cabinet 210 may include opposite sidewalls 218 in the width direction as well as a rear wall. The sidewalls and the rear wall may be referred to as side panels and a rear panel respectively.

The top plate 280 may be seated on the top of the cabinet 210. In addition, the top plate 230 may include protrusions 231 formed on opposite side portions in the width direction of the top plate 230 and a recessed portion 235 formed between the protrusions 231.

Specifically, the protrusions 231 may protrude upward from opposite side portions in the width direction of the top plate 230. In addition, the recessed portion 235 may be formed inside the protrusions 231 in the width direction of the top plate 230.

At least one first cooking unit 220 may be arranged in the recessed portion 235. For example, the first cooking unit 220 may be installed in the recessed portion 235 so that the top of the first cooking unit 220 is exposed from the recessed portion 235.

The heat source used in the first cooking unit 220 or the cavity 240 may be gas or electricity.

In some examples, the first cooking unit 220 may be represented as an ignition unit in which fire is generated via the ignition of gas. In these examples, the gas may be supplied from a gas supply source to the first cooking unit 220, and the first cooking unit 220 may be formed to generate fire for cooking food by igniting the supplied gas.

In addition, at least one cooking container support member 225 may be disposed on the first cooking unit 220. Specifically, the cooking container support member 225 may be disposed on the top plate 230 so as to support a cooking container which is placed on the first cooking unit 220.

The second cooking unit 240 may be provided inside the cabinet 210. For example, the second cooking unit 240 may take the form of a cavity or chamber inside the cabinet 210.

In addition, a heating unit may be provided inside the cabinet 210 to heat food inside the cavity 240 using gas as a heat source.

For example, gas may be supplied from a gas supply source to the cavity 240, and the heating unit provided in the cavity 240 may be formed to generate fire or heat for cooking food by igniting the supplied gas.

The control panel 250 may be coupled to the front end of the top plate 230. Specifically, the control panel 250 may be coupled to the top plate 230 at a position above the door 270, which is provided at the front surface of the cabinet 210 in order to open or close the cavity 240.

The door 270 may be provided at the front surface of the cabinet 210 so as to open or close the cavity 240. The door 270 may include a transparent portion 271 configured to allow the interior of the cavity 240 to be viewed, and a handle 272 for assisting the user in opening or closing the door 270.

In addition, the control panel 250 may include at least one operating unit 255. Specifically, the operating unit 255 may take the form of a rotatable knob.

The user may ignite gas provided to the first cooking unit 220 and the cavity 240 by rotating the operating unit 255, or may adjust the intensity of fire ignited in the first cooking unit 220 and the cavity 240.

The cooking appliance 200 in accordance with the embodiment of the present invention may further include a rear panel 260 installed on the rear end of the upper surface of the cabinet 210.

The rear panel 260 may be provided with a control command input unit 265 for controlling the cavity 240. The control command input unit 265 may be provided on the front surface of the rear panel 260, and may take the form of a touch panel.

In addition, the control command input unit 265 may be formed so as to display information regarding cooking that is performed in the cavity 240 (e.g. cooking courses and cooking time). In addition, the control command input unit 265 may include input units for the input of various commands, such as child lock.

The rear panel 260 may have a first outlet port 261 for discharging at least a portion of the air moving below the top plate 230 and the air moving inside the cabinet 210 to the outside.

The first outlet port 261 may be formed so as to extend the entire width of the rear panel 260. That is, the first outlet port 261 may extend a long length in the left-right direction.

In addition, the first outlet port 261 may be formed in the rear panel 260 at a position below the control command input unit 265. The first outlet port 261 may be formed to cause at least a portion of the air moving below the top plate 230 and the air moving inside the cabinet 210 to be discharged to the front side of the rear panel 260.

For example, an outlet path may be formed inside the rear panel 260, and the air moving below the top plate 230 and inside the cabinet 210 may be discharged from the first outlet port 261 by way of the outlet path.

Accordingly, when the user uses at least one of the first cooking unit 220 and the cavity 240, at least a portion of the high-temperature air below the top plate 230 and inside the cabinet 210 may be discharged outward through the first outlet port 261.

At least one leg 280 may be installed underneath the cabinet 210 so that the cabinet 210 is upwardly spaced apart from the installation plane of the cooking appliance 200.

For example, four legs 280 may be provided underneath the cabinet 210, and the four legs 280 may be provided at four corners of the lower surface of the cabinet 210.

In order to discharge the high-temperature air generated in the first cooking unit 220 and the cavity 240 to the outside of the cooking appliance 200 or to reduce the temperature of the high-temperature air, it is necessary to introduce outside air (e.g. low-temperature outside air) into the cabinet 210.

Therefore, the lower surface of the cabinet 210 is upwardly spaced apart from the installation plane of the cooking appliance 200 by the legs 280. The air outside the cooking appliance 200 may be introduced into the cabinet 210 through the lower side of the cabinet 210 from the front side of the cabinet 210 and the opposite sides in the width direction of the cabinet 210.

For example, as indicated by arrows "A" in FIG. 3, outside air may be introduced into the cooking appliance 200 through the lower side of the cabinet 210 from the front side of the cooking appliance 200 and the opposite sides in the width direction of the cooking appliance 200.

Figure 4:
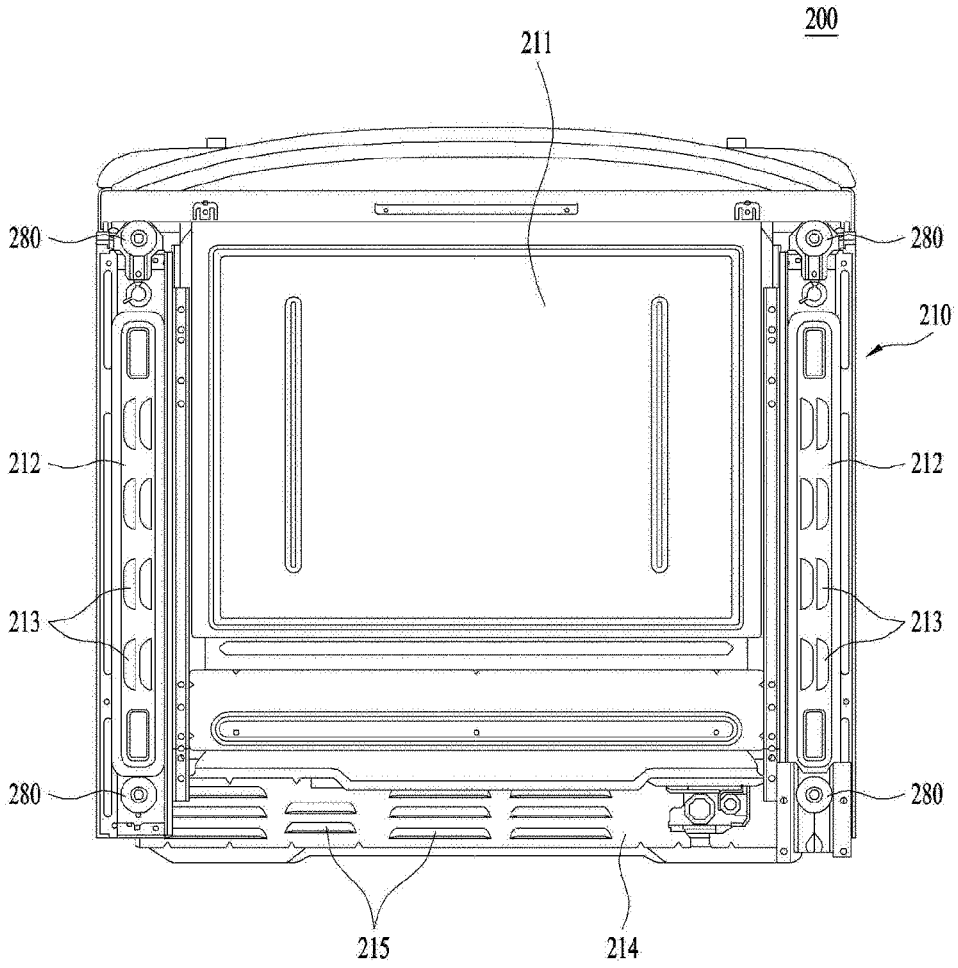
FIG. 4 is a bottom view of the cooking appliance illustrated in FIG. 3.

Referring to FIG. 4, the cabinet 210 may include a bottom panel 211 configured to cover at least a portion of the lower side of the cabinet 210.

Side brackets 212 may be arranged on opposite sides in the width direction of the lower side of the cabinet 210. For example, two side brackets 212 may be installed on opposite side portions in the width direction of the lower side of the cabinet 210.

The side brackets 212 may be formed so as to connect the bottom panel 211 to the lower ends of the opposite sidewalls 218 in the width direction of the cabinet 210.

Each side bracket 212 may be provided with at least one leg 280. The leg 280 may be formed so as to protrude from the side bracket 212 to the installation plane of the cabinet 110 (i.e. the installation plane of the cooking appliance 200).

The lower side of the cabinet 210 may be upwardly spaced apart from the installation plane of the cabinet 210 (i.e. the installation plane of the cooking appliance 200) by a predetermined distance.

In addition, the side bracket 212 may have at least one first air inlet hole 213. The first air inlet hole 213 may be a circular hole, or a slit having a predetermined length.

Accordingly, at least a portion of the outside air introduced through the lower side of the cabinet 210 from the front side and the opposite sides in the width direction of the cabinet 210 (see the arrows "A" in FIG. 3) may be introduced into the cabinet 210 through the first air inlet hole 213 formed in the side bracket 212.

A rear bracket 214 may be disposed at the rear end of the lower side of the cabinet 210. Opposite longitudinal ends of the rear bracket 214 may be coupled respectively to longitudinal one end of each of the two side brackets 212.

The rear bracket 214 may have at least one second air inlet hole 215. The second air inlet hole 215 may be a circular hole, or a slit having a predetermined length.

Accordingly, at least a portion of the outside air introduced through the lower side of the cabinet 210 from the front side and the opposite sides in the width direction of the cabinet 210 (see the arrows "A" in FIG. 3) may be introduced into the cabinet 210 through the second air inlet hole 215 formed in the rear bracket 214.

The outside air (i.e. the low-temperature air) introduced into the cabinet 210 may create airflow for discharging the high-temperature air generated in at least one of the first cooking unit 220 and the cavity 240 to the outside of the cooking appliance 200.

Basically, the temperature of the cabinet 210 is increased by the hot air inside the first cooking unit 220 and the cavity 240, and simultaneously the air inside the cabinet 210 moves upward. Thus, the pressure inside the cabinet 210 is lower than the pressure outside the cabinet 210. For this reason, the outside air may be introduced into the cabinet 210 through the lower side of the cabinet 210.

The outside air (i.e. the low-temperature air) introduced into the cabinet 210 may be mixed with the high-temperature air generated in at least one of the first cooking unit 220 and the cavity 240, thereby serving to reduce the temperature of the high-temperature air.

The flow of the outside air introduced into the cabinet 210 from the lower side of the cabinet 210 (i.e. from the lower side of the cooking appliance 200) will be described in detail with reference to the other drawings.

Figure 5:
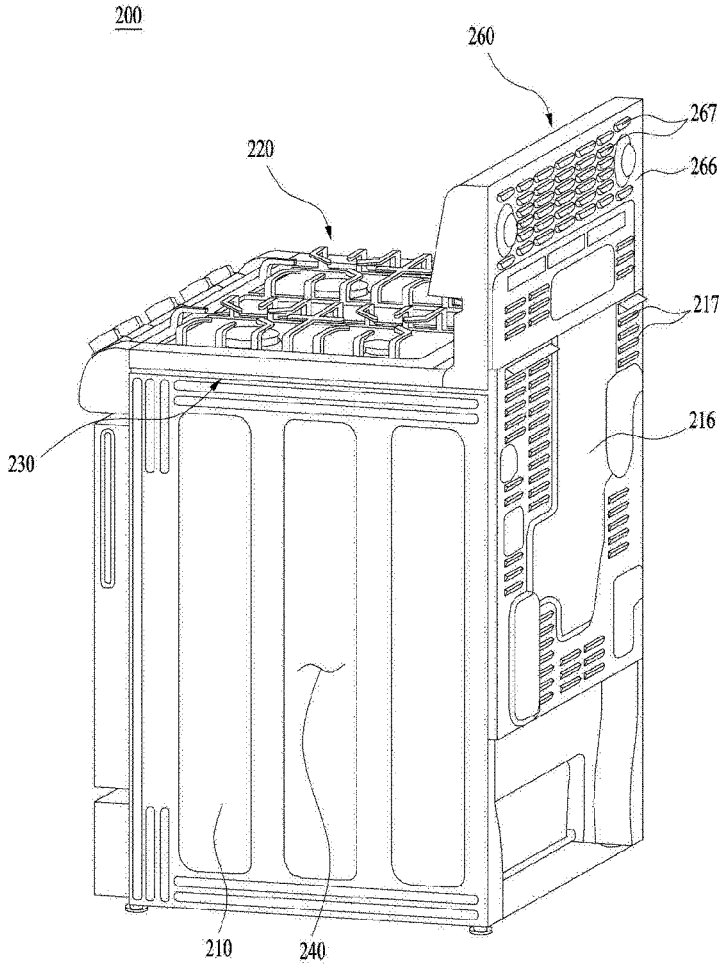
FIG. 5 is a perspective view illustrating the back of the cooking appliance illustrated in FIG. 3.

Referring to FIG. 5, a rear wall 216 of the cabinet 210 may be installed on the rear end of the cabinet 210. That is, the rear wall 216 may be formed so as to cover the rear side of the cabinet 210.

The rear wall 216 may have at least one outlet port 217. As such, when at least one of the first cooking unit 220 and the cavity 240 is operated, at least a portion of the high-temperature air present below the top plate 230 or inside the cabinet 210 may be discharged to the outside of the cabinet 210 (i.e. to the outside of the cooking appliance 200) through the second outlet port 217. That is, when at least one of the first cooking unit 220 and the cavity 240 is operated, the high-temperature air may be generated in at least one of the space below the top plate 230 and the space inside the cabinet 210. In addition, an upward airflow may be created inside the cabinet 210 due to the high-temperature air.

As described above with reference to FIG. 3, the introduced outside air (e.g. the relatively low-temperature air) introduced into the cabinet 210 through the lower side of the cabinet 210 or the lower side of the cooking appliance 200 moves upward inside the cabinet 210.

In addition, the introduced outside air may be mixed with the high-temperature air, thereby being discharged through the second outlet port 217. The outside air serves to remove heat generated in the first cooking unit 220 and the cavity 240.

That is, the introduced outside air serves to reduce the temperature of the high-temperature air generated near the first cooking unit 220 or the cavity 240 when at least one of the first cooking unit 220 and the cavity 240 is operated.

Meanwhile, the rear panel 260 may also include a rear surface portion 266 configured to cover the rear side of the rear panel 260. In addition, the rear surface portion 266 of the rear panel 260 may have at least one third outlet port 267. As such, the introduced outside air as well as the high-temperature air generated near the first cooking unit 220 or the cavity 240 when at least one of the first cooking unit 220 and the cavity 240 is operated may be discharged through the third outlet port 267.

As described above, the outside air introduced into the cabinet 210 and the high-temperature air generated inside the cabinet 210 may be discharged to the outside of the cooking appliance 200 through at least one of the first outlet port 261, the second outlet port 217, and the third outlet port 267.

The air introduced into the cabinet 210 from the lower side of the cabinet 210 may move upward through the space between the cabinet 210 and the cavity 240.

Figure 6:
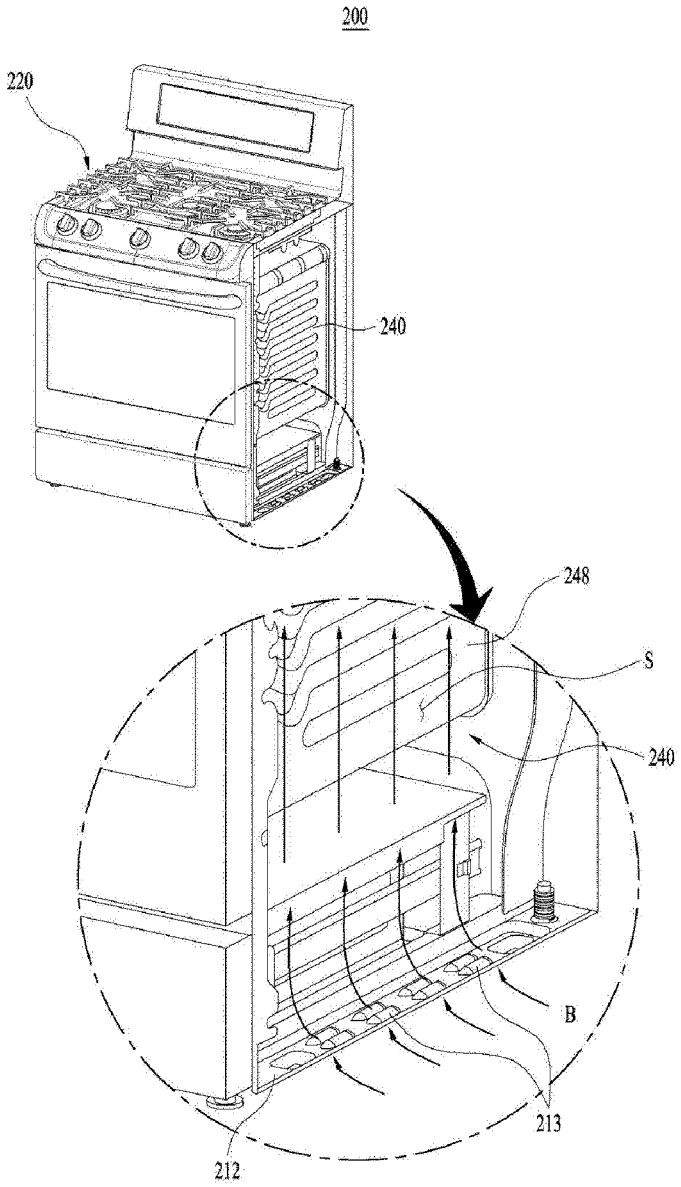
FIG. 6 is a perspective view and a partially enlarged view illustrating the cooking appliance illustrated in FIG. 3 after the removal of a side panel.

Referring to FIGS. 3 and 6, the cabinet 210 includes the sidewalls 218 located at opposite sides in the width direction of the cabinet 210.

The cavity 240 includes sidewalls 248 located at opposite sides in the width direction of the cavity 240.

The sidewall 218 of the cabinet 210 and the sidewall 248 of the cavity 240, which faces the sidewall 218 of the cabinet 210, may be spaced apart from each other. That is, the cavity 240 may be located inside the cabinet 210 such that the sidewall 218 of the cabinet 210 and the sidewall 248 of the cavity 240 are spaced apart from each other. In other words, the space S may be defined between the sidewall 218 of the cabinet 210 and the sidewall 248 of the cavity 240. As such, the outside air introduced from the lower side of the cabinet 210 may move upward inside the cabinet 210 through the space S between the sidewall 218 of the cabinet 210 and the sidewall 248 of the cavity 240.

For example, as exemplarily illustrated in FIG. 6, the relatively low-temperature outside air and the relatively high-temperature air inside the cabinet 210 may move upward in the direction designated by arrows B through the space S.

At least a portion of the air moving upward inside the cabinet 210 may move to the underneath of the top plate 230, and may be discharged to the outside through one of the first outlet port 261, the second outlet port 217, and the third outlet port 267 described above.

As described above, it will be appreciated that natural convection may occur inside the cabinet 210 as the temperature inside the cabinet 210 is increased. That is, convection for causing the upward movement of air may occur inside the cabinet 210.

The present implementation describes a cooking appliance capable of preventing an increase in the temperature of the control panel 250 using natural convection as described above.

Figure 7:
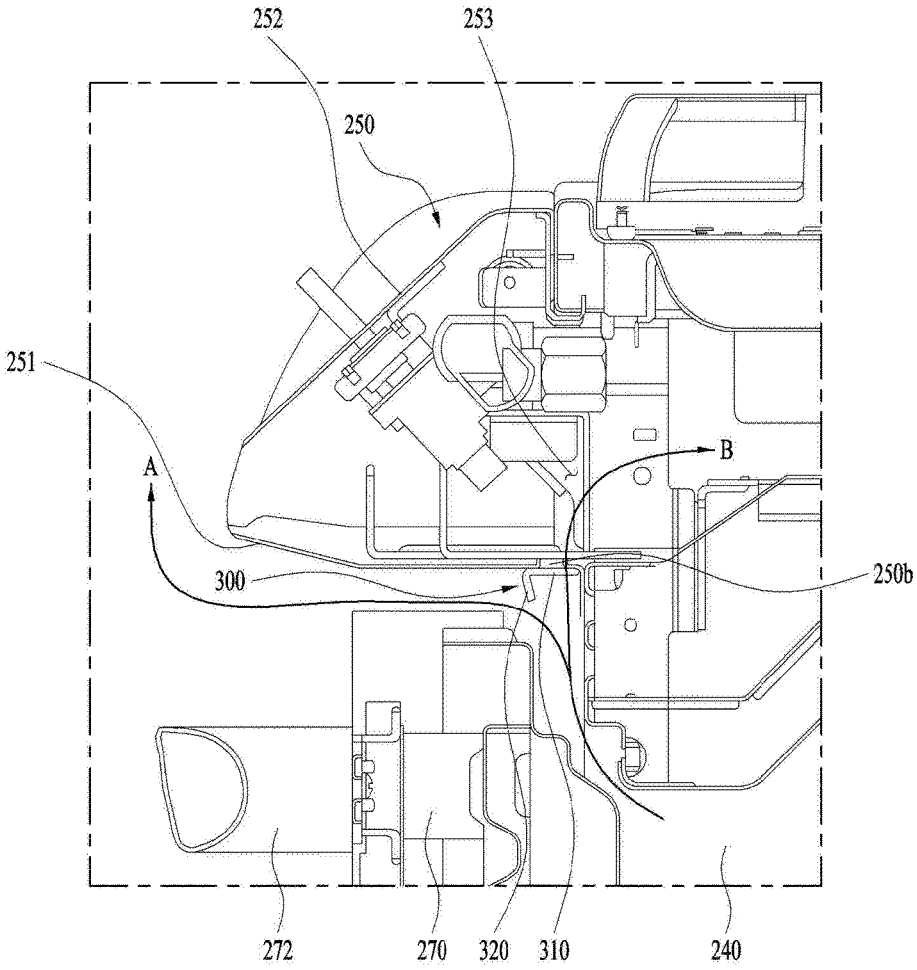
FIG. 7 is a partial sectional view illustrating a control panel of the cooking appliance illustrated in FIG. 3.
Figure 8:
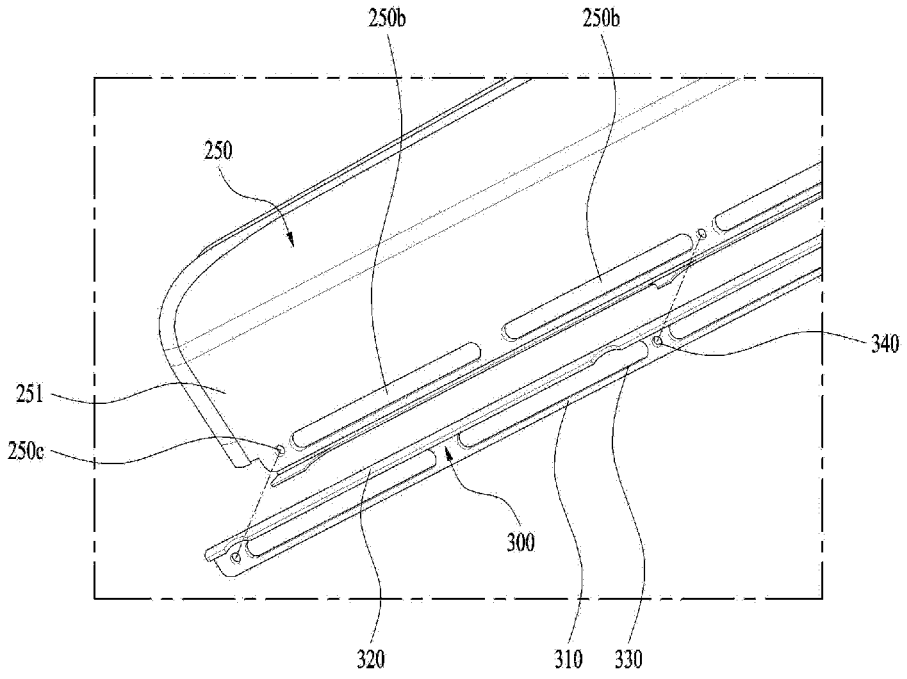
FIG. 8 is a bottom perspective view illustrating the lower surface of the control panel illustrated in FIG. 3.
Figure 9:
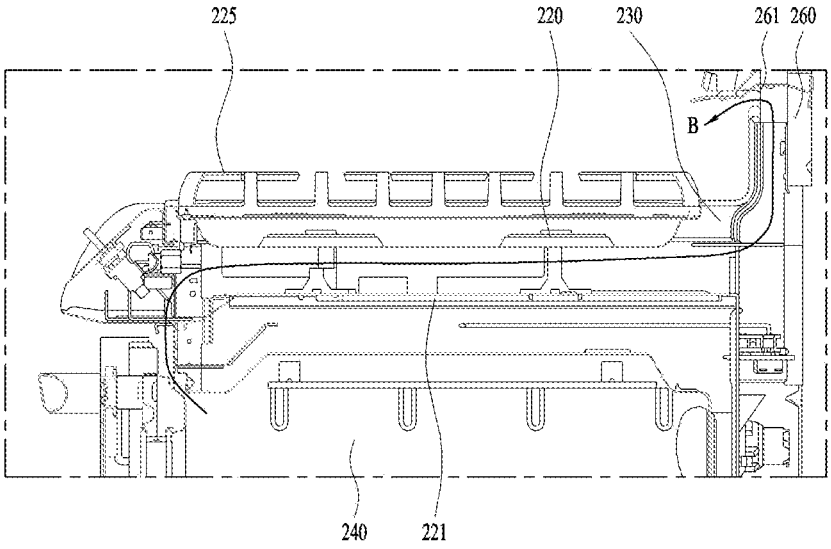
FIG. 9 is a sectional view illustrating the upper portion of the cooking appliance illustrated in FIG. 3.

As illustrated in FIGS. 7-9, the control panel 250 includes a front inclined surface 250 and a lower surface 251. The inclined surface, the lower surface, and the opposite side surfaces define a given space for accommodating various components therein. The control panel 250 has an opening 253 formed in the rear surface thereof. The opening 253 is open to the inside of the cabinet 210 of the cooking appliance 200.

The space inside the cabinet 210 is the space in which natural convection occurs as described above. That is, the hot air inside the cavity 240 discharged from the front upper side of the door 270 may be introduced into the interior space of the cabinet 210 through the interior space of the control panel 250.

The hot air inside the cavity 240, introduced into the interior space of the cabinet 210, is discharged to the outside of the cabinet 210 via natural convection as described above.

Specifically, the hot air inside the cavity 240, discharged from the front upper side of the door 270, moves upward to thereby collide with the lower surface 251 of the control panel 250. Then, the hot air is generally discharged to the front side of the cooking appliance 200 through the gap between the lower surface 251 and the door 270.

The hot air is transferred to the control panel 250 and may cause an increase in the temperature of the control panel 250. An inlet port, through which the air is introduced into the cabinet 210, may be formed in the gap. However, because the inlet port is located in the front of the cavity 240 or the cabinet 210, foreign substances may be introduced into the cabinet 210 through the inlet port.

As illustrated in FIG. 8, an air passage 250*b* may be formed in the lower surface 251 of the control panel 250. That is, the air may be introduced into the control panel 250 through the air passage 250*b* from the outside of the control panel 250.

The air passage 250*b* may be formed at a rear position in the lower surface 251 of the control panel 250. The air passage 250*b* may be formed at the position closest to the cavity 240. The air passage 250*b* may be formed above the contact surface at which the door 270 and the cavity 240 come into close contact with each other. The hot air discharged through the contact surface and moved upward may be introduced into the air passage 250*b*, rather than being discharged to the front side of the cabinet 210.

The air introduced into the control panel 250 through the air passage 250*b* may be introduced into the cabinet 210 through the rear opening 253 formed in the control panel 250.

Accordingly, the air passage 250*b* may take the form of an elongated hole extending in the left-right direction so as to prevent the hot air moved upward from being discharged to the front side of the cabinet 210. A plurality of air passages 250*b* may be formed.

Through the position and shape of the air passage 250*b* described above, the time and area for heat transfer between the hot air and the control panel 250 may be remarkably reduced. In addition, unlike the conventional cooking appliances, the outside air may be introduced through the gap between the control panel 250 and the door 270. The air introduced through the gap as well as the hot air may be introduced into the control panel 250.

Accordingly, the outside air having a low temperature may have the effect of cooling the lower surface 251 of the control panel 250.

Meanwhile, the air moved upward through the contact surface may form a turbulent air stream around the air passage 250*b*. Through the formation of the turbulent air stream, the hot air may not be smoothly introduced into the air passage 250*b*. Therefore, a partition 320 may be formed in front of the air passage 250*b*. The partition 320 may be formed integrally with the control panel 250, or may be formed via a bracket as will be described below. The partition 320 may be integrally formed with the control panel 250 by coupling a separate member to the control panel 250.

As illustrated in FIGS. 7 and 8, the bracket 300 may include a base 310 configured to come into close contact with the lower surface of the control panel 250, and the partition 320 bent from the base 310. The partition 320 may be bent from the base 310 so as to be rearwardly and downwardly inclined. With this shape, the outside air in front of the partition 320 may smoothly pass over the partition 320, but the air at the rear of the partition 320 may not pass over the partition 320.

The base 310 has a base hole 330 corresponding to the air passage 250*b*. In addition, a fastening hole 340 for the coupling between the bracket 300 and the control panel 250 may be formed in the base 310. Of course, a fastening hole 250*c* corresponding to the fastening hole 340 may be formed in the lower surface 251 of the control panel 250.

Through the air passage 250*b* and the partition 320, as exemplarily illustrated in FIG. 7, the flow of air is generated along a path "B", rather than a path "A". Accordingly, the area and time for heat exchange between the hot air and the control panel 250 may be minimized.

The air introduced from the interior of the control panel 250 into the cooking appliance 200 may be directed to the rear side along the space between the cavity 240 and a burner case 221, thereby being discharged to the outside of the cooking appliance 200 through the first outlet port 261 described above.

The burner case 221 serves to accommodate a gas or electric heater provided in the first cooking unit 220. The burner case 221 may be located below the top plate 230. Accordingly, the air may move through the space between the cavity 240 and the top plate 230. Specifically, the flow of air may be created in the space between the top plate 230 and the burner case 221.

The flow of air in the space between the cavity 240 and the burner case 221 is created via natural convection as described above. Therefore, in order to expand natural convection to the underneath of the control panel 250, the air passage 250*b* may be formed in the lower surface 251 of the control panel 250.

The air passage 250*b* is substantially parallel to the ground surface. Thus, the cross-sectional area for the passage of the upwardly moving air may be maximized. In addition, the air passage 250*b* is formed at a position where it is difficult for the user who is in front of the cooking appliance to view it. This is because the gap between the lower surface 251 of the control panel 250 and the door 270 is small, and the air passage 250*b* is formed so as to be parallel to the ground surface, rather than being perpendicular to the ground surface.

In some examples, the temperature of the control panel may be below 67° C. in the state in which both the first cooking unit 220 and the cavity 240 are operated.

Figure 10:
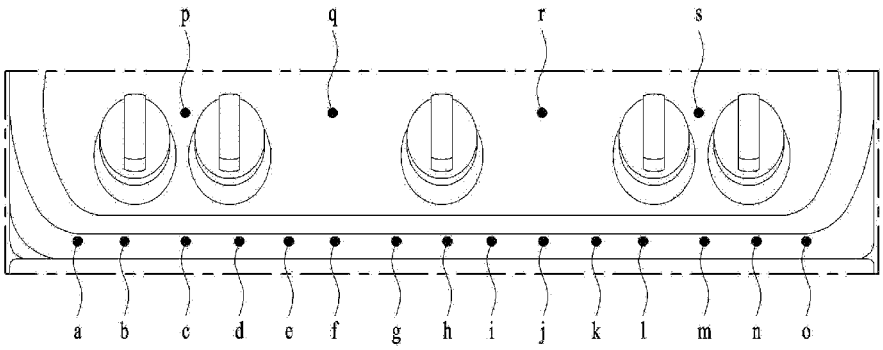
FIG. 10 is a front view illustrating positions of temperature measurement points on the inclined surface of the control panel of the cooking appliance illustrated in FIG. 3.

As illustrated in FIG. 10, the temperature may be measured at a plurality of points on the front surface of the control panel 250 to which user access is allowed.

In some examples, the temperatures at all of the measurement points close to the lower surface of the control panel 250 may be below 60° C. The temperature may be reduced with a decrease in the distance to the right or left side of the control panel 250, and may be increased with a decrease in the distance to the lower surface 251 of the control panel 250.

Although implementations have been illustrated and described above, it will be apparent to those skilled in the art that the implementations are provided to assist understanding of the present disclosure and the present disclosure is not limited to the above described implementations. Various modifications and variations can be made without departing from the spirit or scope of the present disclosure.

What is claimed is:

1. A cooking appliance comprising:

a case that defines a cavity for a cooking space;

a top plate that is disposed above the cavity and that is configured to define an external appearance of a top side of the cooking appliance;

a control panel that is disposed at a front upper position of the cavity and that is configured to define an external appearance of a front side of the cooking appliance, the control panel having a knob for user operation; and a door that is disposed below the control panel and that is configured to define, along with the control panel, the external appearance of the front side of the cooking appliance, the door being configured to open or close the cavity, wherein the control panel includes an air passage that is defined in a lower surface of the control panel, that receives air discharged from the cavity through the door via natural convection, and that introduces received air into an interior space of the control panel via natural convection, and wherein the control panel includes a rear opening that is configured to allow communication between the interior space of the control panel and an interior space of the cooking appliance, and that is positioned higher than the air passage.

2. The cooking appliance according to claim 1, wherein the rear opening is configured to allow communication between a space defined between the top plate and the cavity, and the interior space of the control panel.

3. The cooking appliance according to claim 2, further comprising a burner case provided between the cavity and the top plate, wherein the rear opening is configured to allow communication between a space defined between the top plate and the burner case, and the interior space of the control panel.

4. The cooking appliance according to claim 1, wherein the air passage is configured to be substantially parallel to a ground surface.

5. The cooking appliance according to claim 4, wherein the air passage is defined as an elongated hole with a horizontal orientation.

6. The cooking appliance according to claim 5, wherein the air passage is located at a rear position in the lower surface of the control panel.

7. The cooking appliance according to claim 1, further comprising a partition provided on the lower surface of the control panel at a position in front of the air passage.

8. The cooking appliance according to claim 7 further comprising a bracket with a base coupled to the lower surface of the control panel, the base including a base hole corresponding to the air passage.

9. The cooking appliance according to claim 8, wherein the partition is configured to be rearwardly and downwardly inclined.

10. The cooking appliance according to claim 7, wherein the partition is bent downward from the base.

11. The cooking appliance according to claim 1, wherein the control panel is a manifold-type control panel configured to include a front inclined surface, opposite side surfaces, and the lower surface, wherein the lower surface is configured to protrude forward from a front surface of the door.

12. The cooking appliance according to claim 11, wherein the inclined surface is provided with a plurality of knobs for user operation.

13. The cooking appliance according to claim 1, further comprising a rear panel that is configured to define a rear side of the cooking appliance, the rear panel including an outlet port configured to discharge air inside the cooling appliance.

14. The cooking appliance according to claim 1, wherein the air passage is vertically above a contact surface at which the door and the cavity come into contact with each other.

15. A cooking appliance comprising:

a cabinet;

a cavity provided inside the cabinet that is configured to form a cooking space;

a top plate that is disposed above the cavity that is configured to define an external appearance of a top side of the cooking appliance;

a door that is configured for opening or closing the cavity; and a control panel that is disposed above an upper end surface of the door and configured to include a gap between the control panel and the end surface of the door, the control panel and the door configured to define an external appearance of a front side of the cooking appliance, the control panel including a lower surface which is configured to protrude further forward than the upper end surface of the door, wherein the control panel includes an air passage formed at a rear position in the lower surface of the control panel, wherein the air passage is configured to allow hot air discharged from the cavity to be introduced into an interior space of the control panel via natural convection, and wherein the control panel includes a rear opening that is configured to discharge the hot air from the interior space of the control panel to an interior space of the cooking appliance via natural convection.

16. The cooking appliance according to claim 15, wherein the air passage is configured to have a longer left-right length than a front-rear length, and is configured to be parallel to a ground surface.

17. The cooking appliance according to claim 15, wherein a partition is provided in front of the air passage to separate a front region and a rear region of the air passage from each other.

18. The cooking appliance according to claim 17, wherein the partition is configured to extend downward from the lower surface of the control panel in a direction in which the gap is reduced.

19. The cooking appliance according to claim 15, wherein hot air introduced into the control panel through the air passage is configured to pass through a rear opening formed in the control panel, a space between the top plate and a burner case, provided between the cavity and the top plate, and an outlet port formed in a rear panel provided for forming a rear side of the cooling appliance, to be discharged to an outside of the cooking appliance.

* * * * *